US006439937B1

(12) United States Patent
Mansson et al.

(10) Patent No.: US 6,439,937 B1
(45) Date of Patent: Aug. 27, 2002

(54) BOAT PROPELLER TRANSMISSION

(75) Inventors: Staffan Mansson, Hjalteby; Oddbjorn Hallenstvedt, Koping, both of (SE)

(73) Assignee: AB Volvo Penta, Gothenburg (SE)

( * ) Notice: Subject to any disclaimer, the term of this patent is extended or adjusted under 35 U.S.C. 154(b) by 0 days.

(21) Appl. No.: 09/868,312

(22) PCT Filed: Dec. 15, 1999

(86) PCT No.: PCT/SE99/02372

§ 371 (c)(1),
(2), (4) Date: Sep. 7, 2001

(87) PCT Pub. No.: WO00/38981

PCT Pub. Date: Jul. 6, 2000

(30) Foreign Application Priority Data

Dec. 16, 1998 (SE) ..... 9804359

(51) Int. Cl.[7] ..... B63H 20/20
(52) U.S. Cl. ..... 440/75; 475/315
(58) Field of Search ..... 440/75, 80, 81; 475/314, 315

(56) References Cited

U.S. PATENT DOCUMENTS 3,164,036 A * 1/1965 Lamburn et al. ..... 192/109 B
3,532,068 A * 10/1970 Lamburn ..... 440/75
4,118,996 A * 10/1978 Eichinger ..... 440/75
4,860,615 A 8/1989 Huber et al.
5,839,928 A 11/1998 Nakayasu et al.
6,027,424 A * 2/2000 Reynolds ..... 475/269

FOREIGN PATENT DOCUMENTS

| | | |
|---|---|---|
| GB | 2067684 | 7/1981 |
| SE | 412885 | 6/1979 |
| WO | WO 98/41447 | 9/1998 |

* cited by examiner

*Primary Examiner*—Sherman Basinger
(74) *Attorney, Agent, or Firm*—Young & Thompson

(57) ABSTRACT

Boat propeller transmission with a horizontal input shaft, a bevel gear set, a vertical intermediate shaft, an additional bevel gear set, and at least one horizontal propeller shaft. Between the bevel gear sets, a two-speed planetary gear set is coupled, to provide two gear speeds in the same direction between the input shaft and the propeller shaft. The planetary gear set has a sun gear which can be locked against the housing of the planetary gear set with the aid of a one-way clutch.

8 Claims, 2 Drawing Sheets

BOAT PROPELLER TRANSMISSION

Figure 1:
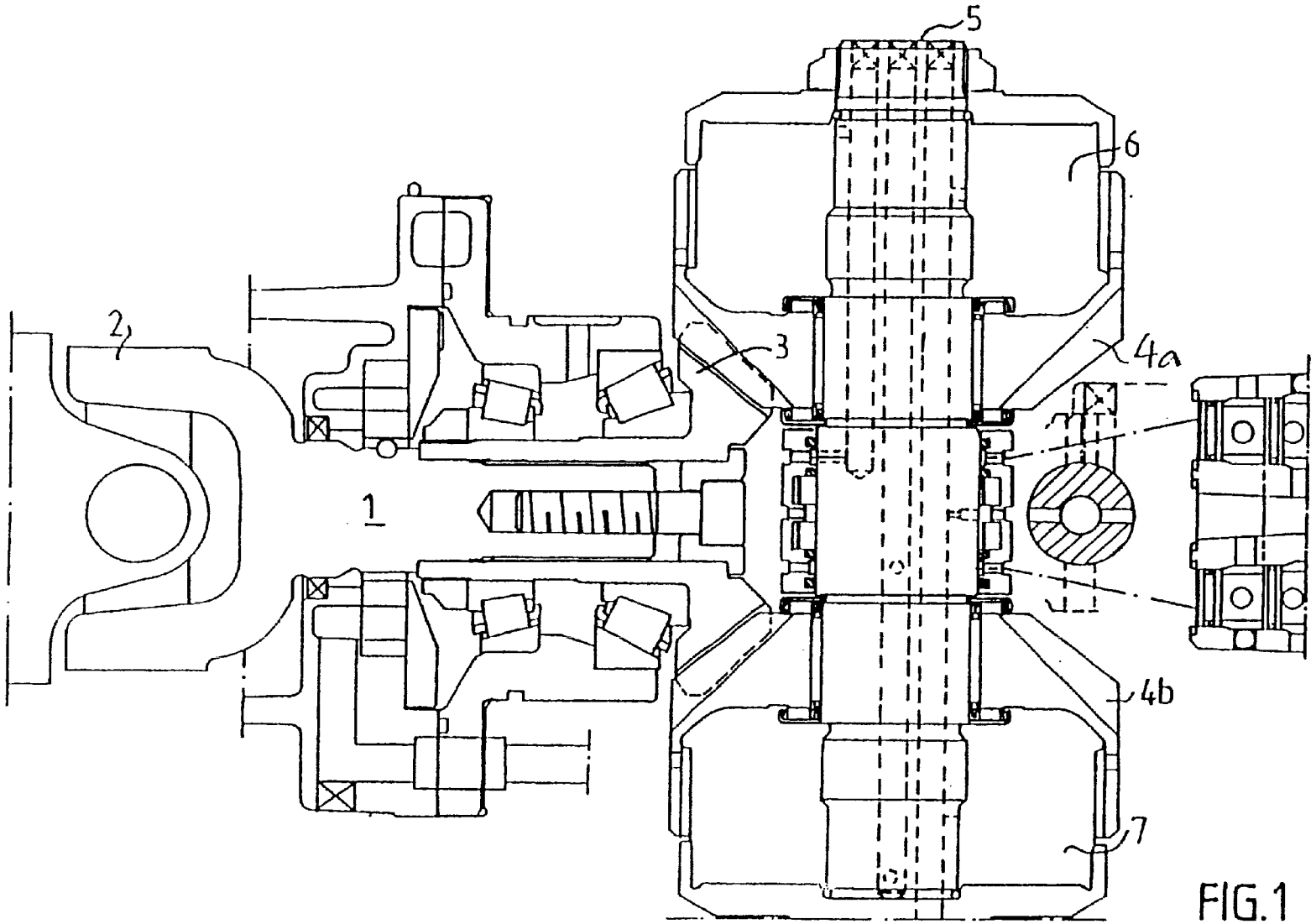

The present invention relates to a boat propeller transmission comprising an input shaft intended to be connected to an output shaft from a drive installation, an intermediate shaft driven by said input shaft via a first bevel gear set, at least one propeller shaft driven by said intermediate shaft via a second bevel gear set, a reversing mechanism for reversing the rotational direction of the propeller shaft relative to said input shaft, and a planetary gear set, providing at least two different gear speeds in the same direction between the input shaft and the propeller shaft.

Boat propeller transmissions, e.g. in propeller drives of the type which are steerably and tiltably mounted on the outside of a boat transom and which are drivably coupled to an inboard engine, usually have only a reversing transmission for reversing the rotational direction of the propeller shaft. Recently, however, two-speed propeller drives have been developed primarily for achieving more rapid acceleration so that the boat will more rapidly reach the planing position for better fuel economy. In boats with turbo-charged diesel engines, the poor charging capacity of the turbo unit at low engine rpm has been compensated with a displacement compressor, which is mechanically driven by the engine and which is coupled in series with the turbo compressor and supercharges in the low rpm range of the engine, but which is disconnected as soon as the charging capacity of the turbo compressor exceeds the charging capacity of the displacement compressor. In this manner, rapid acceleration is achieved, so that the planing position can be rapidly reached. With a two-speed propeller drive unit with a low gear and a direct gear, the engine in low gear reached earlier the rpm at which the turbo compressor charges efficiently, which provides more rapid acceleration and earlier planing over a single speed transmission. With a two-speed drive unit it is possible in a boat with an engine only turbo-charged, to achieve approximately the same performance as a boat with a single speed drive unit and an engine with both a turbo compressor and a displacement compressor. The cost of manufacturing a propeller drive unit with an extra gear speed is, however, significantly lower than the extra cost for the displacement compressor installation.

The purpose of the present invention is to achieve a boat propeller transmission of the type described by way of introduction, with a planetary gear set in a compact and simple design, so that the planetary gear set, when used in an outboard drive, for example, can be placed in the drive leg, maling it possible with a minimum of modification of a single speed drive, to develop it to a two-speed drive.

This is achieved according to the invention by virtue of the fact that the planetary gear set (9) has a gear set housing and a sun gear, which is lockable relative to the housing by means of a releasable one-way clutch, which strives to lock the sun gear upon rotation of a shaft of the planetary gear set in one direction and to release the sun gear upon rotation of the shaft in the opposite direction, and that disengagement means are coordinated with the one-way clutch to permit selective disengagement of the one-way clutch for releasing the sun gear when the shaft rotates in said first mentioned direction.

A preferred embodiment of the transmission according to the invention is characterized in that the planetary gear set has a sun gear which is non-rotatably joined to a sleeve element, which is mounted concentrically with said last mentioned shaft and has an external thread in engagement with an internal thread of a bore in a clutch element, which has an external conical frictional surface which, upon axial displacement of the clutch element, is displaceable into or out of engagement with a facing conical surface of a housing element, that the thread is so formed in relation to the rotational said last mentioned shaft when driving forwards, that the frictional surface of the clutch element is pressed against the frictional surface of the housing upon turning of the sleeve relative to the clutch element, and that hydraulic disengaging means are arranged to displace the clutch element, so that its frictional surface is moved out of engagement with the facing frictional surface.

Such a clutch for locking the sun gear of the planetary gear set is particularly suitable for vertical mounting, for example, in the rig of an outboard drive, by virtue of the fact that the clutch element will then be loaded axially by gravity, which can be used to initially move the frictional surfaces into engagement with each other, and that the engaging force will then be increased by the thread engagement. Only disengagement need be effected by force, while the engagement can occur automatically when the hydraulically operated means are deactivated. In a preferred embodiment of a transmission according to the invention, the clutch element itself is also a piston element in a cylinder, which results in a very simple and compact design.

Figure 2:
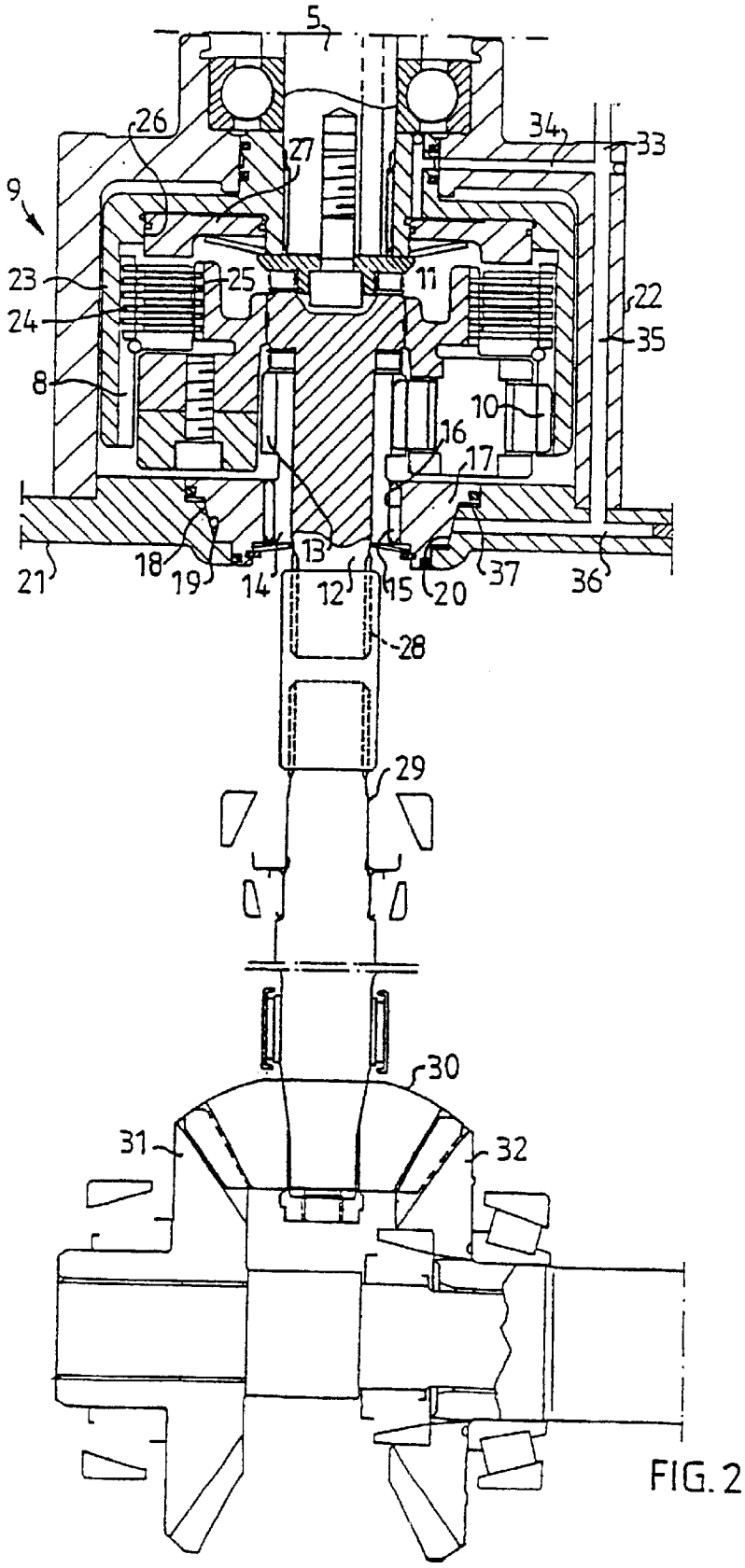

The invention will be described in more detail below with reference to an example shown in the accompanying drawing, where FIG. 1 shows an upper longitudinal section, and FIG. 2 shows a lower longitudinal section through one embodiment of a boat propeller transmission according to the invention.

The transmission shown in the figures is of the type which, in a single-speed version, is used in steerable and tiltable outboard drives. The transmission shown is used in an outboard drive of the type commercially available under the trademark Aquamatic®. The transmission has an input shaft 1, the outer end of which is joined to a universal knuckle intended to be drivably coupled to the output shaft from an engine. At its inner end, the axle is solidly joined to a bevel gear 3 engaging two bevel gears 4*a* and 4*b,* which are freely rotatably mounted on an intermediate shaft 5, mounted perpendicularly to the input shaft 1. The gears 4*a* and 4*b* can be alternatingly locked to the intermediate shaft 5 with the aid of individual clutches 6 and 7 for driving the intermediate shaft 5 in one direction or the other. These can be hydraulically operated, multi-disc wet-disc clutches.

The lower end of the intermediate shaft 5 is non-rotatably joined to a ring gear 8 in a planetary gear set, generally designated 9. The ring gear engages planet gears 10, which are mounted on a planet gear carrier 11, which is joined to an output shaft 12 from the planetary gear set 9. The planet gears can engage a sun gear 13 made integral with a sleeve 14, through which the output shaft 12 extends. The sleeve 14 is rotatably mounted on the shaft 12 and has an externally threaded portion 15, which engages an internal thread in a bore 16 in a conical clutch element 17 having an external conical frictional surface 18 facing a conical frictional surface 19 of a bore 20 in an end plate 21 of a stationary housing 22. The clutch element 17 forms at the same time an operating piston, and the bore 20 forms a cylinder in which the piston is axially displaceable. The ring gear 8 is made integral with a bowl-shaped carrier 23 of discs 24 arranged alternatingly with discs 25 on the planet gear carrier 11. The carrier 23 also forms a cylinder 26 for a piston 27 by means of which the package of discs 25, 26 can be pressed together to lock the ring gear 8 to the planet gear carrier 11.

The output shaft 12 is joined via splines 28 to an input shaft 29 leading to a bevel gear set formed of three bevel gears 30, 31, 32, of which the gear 30 is joined to the shaft 29 while the gears 31 and 32 are joined to two concentric propeller shafts, thus driven counter-rotationally.

In the position shown in FIG. 2 of the components, i.e. with the clutch 25, 26 disengaged and the clutch element 17 and thus also the sun gear 13 locked against rotation, the low gear speed of the planetary gear set is engaged, i.e. the planet gear carrier 11 and the output shaft 12 rotate at a lower rotational speed than the intermediate shaft and the ring gear 8. Sufficiently high friction between the frictional surfaces 18 and 19 for locking the sun gear 13 is thus achieved by virtue of the fact that the thread 15 is so selected in relation to the reactive torque direction against the sun gear 13 when driving forwards that the conical element is affected by a downwardly directed force so that the frictional surfaces 18, 19 are pressed against each other.

In a boat with a turbo-charged diesel engine, with low gear engaged, the rpm at which the charging capacity of the turbo compressor exceeds the capacity of a mechanically driven displacement compressor is rapidly reached. When this rpm has been reached, the higher gear speed (direct drive) is engaged. Shifting is effected by hydraulic fluid under pressure being conducted to an inlet 33 in the planetary gear housing 22. Via channels 34, 35 and 36, the fluid is conducted to the cylinder chamber 26 behind the piston 27 and to a cylinder chamber 37 between the clutch element 17 and the housing end plate 21. From the channel 36, the fluid flows in between the clutch element and the housing end plate by virtue of the fact that the frictional surfaces 18, 19 are profiled so as to provide a certain amount of leakage therebetween. The oil pressure in the cylinder chamber 37 lifts the clutch element 17 so that the sun gear 13 is disengaged from the housing end plate 21. At the same time the oil pressure in the cylinder chamber 26, via the piston 27, presses the package of discs 24, 25 together so that the entire planetary gear unit is locked together as a unit and forms a direct drive connection between the intermediate shaft 5 and the output shaft 12.

What is claimed is:

1. Boat propeller transmission, comprising an input shaft (1) for connection to an output shaft from a drive installation, an intermediate shaft driven by said input shaft via a first bevel gear set (3, 4*a*, 4*b*), at least one propeller shaft driven by said intermediate shaft via a second bevel gear set (30, 31, 32), a reversing mechanism (6, 7) for reversing the rotational direction of the propeller shaft relative to said input shaft, and a planetary gear set (9), providing at least two different gear speeds in the same direction between the input shaft and the propeller shaft, characterized in that the planetary gear set (9) has a gear set housing (21, 22) and a sun gear (13), which is lockable relative to the housing by means of a releasable one-way clutch (14, 15, 16, 17), which strives to lock the sun gear upon rotation of a shaft (12) of the planetary gear set in one direction and to release the sun gear upon rotation of the shaft in the opposite direction, and that disengagement means (17, 21, 37) are coordinated with the one-way clutch to permit selective disengagement of the one-way clutch for releasing the sun gear when the shaft rotates in said first mentioned direction.

2. Transmission according to claim 1, characterized in that the sun gear (13) is non-rotatably joined to a sleeve element (14), which is mounted concentrically with said last mentioned shaft (12) and has an external thread (15) in engagement with an internal thread of a bore (16) in a clutch element (17), which has an external conical frictional surface (18) which, upon axial displacement of the clutch element, is displaceable into or out of engagement with a facing conical surface (19) of a housing element (21), that the thread is so formed in relation to the rotational said last mentioned shaft (12) when driving forwards, that the frictional surface of the clutch element is pressed against the frictional surface of the housing upon tuning of the sleeve relative to the clutch element, and that hydraulic disengaging means (17, 21, 37) are arranged to displace the clutch element, so that its frictional surface is moved out of engagement with the facing frictional surface.

3. Transmission according to claim 2, characterized in that the clutch element (17) is joined to a piston in a hydraulic cylinder.

4. Transmission according to claim 3, characterized in that the clutch element (17) is made in one piece with the piston.

5. Transmission according to claim 2, characterized in that the input shaft (5) of the planetary gear set (9) non-rotatably carries a ring gear (8), which engages planet gears (10) on a planet gear carrier (11), which is non-rotatably joined to an output shaft (12), mounted concentrically with the sleeve element (14), and that clutch means (24, 25) are arranged between the ring gear and the planet gear carrier, by means of which the ring gear can be locked to or released from the planet gear carrier.

6. Transmission according to claim 5, characterized in that said clutch means are formed of a hydraulically operated, multi-disc wet-disc clutch (24, 25).

7. Transmission according to claim 1, characterized in that the planetary gear set is disposed between the bevel gear sets (3, 4*a*, 4*b*, and 30, 31, 32).

8. Transmission according to claim 1, characterized in that it is included in a steerable and tiltable outboard drive, intended to be mounted on the outside of a boat transom, and that the input shaft (1) at its outer end is joined to a universal joint (2), intended to be joined to the output shaft from an engine.

* * * * *